US006335094B1

(12) United States Patent
Owaki et al.

(10) Patent No.: US 6,335,094 B1
(45) Date of Patent: Jan. 1, 2002

(54) FIBER STRUCTURE, CLOTHS USING SAME, AND TEXTILE GOODS

(75) Inventors: Shinji Owaki, Aichi; Toshimasa Kuroda, Osaka; Susumu Shimizu, Kanagawa; Akio Sakihara, Kanagawa; Kinya Kumazawa, Kanagawa; Hiroshi Tabata, Yokohama, all of (JP)

(73) Assignees: Nissan Motor Co., Ltd., Yokohama; Tanaka Kikinzoku Kogyo K.K., Tokyo; Teijin Limited, Osaka, all of (JP)

( * ) Notice: Subject to any disclaimer, the term of this patent is extended or adjusted under 35 U.S.C. 154(b) by 0 days.

(21) Appl. No.: 09/066,817

(22) Filed: Apr. 28, 1998

(30) Foreign Application Priority Data

Apr. 28, 1997 (JP) ..... 9-111625
Oct. 17, 1997 (JP) ..... 9-285622

(51) Int. Cl.[7] ..... D02G 3/00

(52) U.S. Cl. ..... 428/374; 428/370; 428/372; 428/373; 428/365

(58) Field of Search ..... 428/385, 370, 428/372, 373, 374, 365, 690; 51/289

(56) References Cited

U.S. PATENT DOCUMENTS

| | | | | |
|---|---|---|---|---|
| 5,407,738 | A | 4/1995 | Tabata et al. | 428/229 |
| 5,472,798 | A | 12/1995 | Kumazawa et al. | 428/690 |

FOREIGN PATENT DOCUMENTS

| | | |
|---|---|---|
| EP | 0 686 858 A2 | 12/1995 |
| EP | 0 767 260 A2 | 4/1997 |
| GB | 2 297 752 A | 8/1996 |
| JP | 3-213536 | 9/1991 |
| JP | 6-17349 | 1/1994 |
| JP | 6-101169 | 4/1994 |
| JP | 7-34324 | 2/1995 |
| JP | 7-195603 | 8/1995 |
| WO | 97/21855 | 6/1997 |

*Primary Examiner*—Rena L. Dye
*Assistant Examiner*—Michael C. Miggins
(74) *Attorney, Agent, or Firm*—Foley & Lardner

(57) ABSTRACT

A fiber structure with a cross section having x-axis and y-axis directions includes an alternate lamination including a first portion having a refractive index na and a thickness da and a second portion adjacent to the first portion and having a refractive index nb and a thickness db, wherein when $1.0 \leqq na < 1.8$, $1.3 \leqq nb \leqq 1.8$, and $1.01 \leqq nb/na \leqq 1.80$, a primary peak wavelength $\lambda 1$ which is equal to 2(nada+nbdb) is given by $\lambda 1 \geqq 0.78$ or 1.6 ($\mu$m).

31 Claims, 13 Drawing Sheets

FIG.13

| | AMOUNT OF SODIUM SULFOISOPHTHALATE COPOLYMERIZED (mole%) | FLATTENING RATIO | THICKNESS OF POLYETHYLENE TEREPHTHALATE LAYER (microns) | THICKNESS OF NYLON LAYER (microns) | OBSERVATIONS |
|---|---|---|---|---|---|
| COMPARATIVE EXAMPLE A | 0 | 2.7 | 0.331 | 0.330 | SOME BREAKAWAY |
| EXAMPLE A | 0.2 | 3.0 | 0.152 | 0.161 | PRESENCE OF BROAD PEAK IN THE VICINITY OF 0.97μm WAVELENGTH |
| EXAMPLE B | 0.6 | 4.2 | 0.150 | 0.150 | PRESENCE OF BROAD PEAK IN THE VICINITY OF 0.96μm WAVELENGTH |
| EXAMPLE C | 1.5 | 4.8 | 0.156 | 0.163 | PRESENCE OF DISTINCT PEAK AT 1.00μm WAVELENGTH |
| EXAMPLE D | 3.0 | 5.2 | 0.154 | 0.160 | PRESENCE OF RATHER BROAD PEAK AT 1.00μm WAVELENGTH |
| COMPARATIVE EXAMPLE B | 6.0 | 5.5 | 0.152 | 0.158 | DIFFICULT FIBERIZATION DUE TO OCCASIONAL SNAPPING |
| COMPARATIVE EXAMPLE C | 10.0 | 5.5 | 0.152 | 0.159 | QUITE DIFFICULT FIBERIZATION DUE TO FREQUENT SNAPPING |

FIBER STRUCTURE, CLOTHS USING SAME, AND TEXTILE GOODS

BACKGROUND OF THE INVENTION

The present invention relates to a fiber structure which serves to intercept or shut out radiation in the infrared region by reflection, interference, etc. to provide coolness. The present invention also relates to cloths using the fiber structure and textile goods using such cloths.

As is well known, the spectrum of sunlight arriving on the earth's surface has a wide extent ranging from the ultraviolet region to the infrared region. Comparison of the distribution of energy of sunlight by wavelengths reveals that the ultraviolet region with wavelength between 0.29 and 0.40 $\mu$m corresponds to 6%, the visible region with wavelength between 0.40 and 0.78 $\mu$m corresponds to about 52%, and the infrared region with wavelength of 0.78 $\mu$m or more corresponds to about 42%.

It is thus understood that sunlight contains a unnegligible amount of infrared rays or energy. Infrared rays are also called "heat rays" since they are easily absorbed by objects to produce heat vibration of molecules, resulting in a temperature rise of the objects.

Conventionally, there is, in various fields, an increasing demand for development of products which can intercept or shut out infrared rays to avoid thermal influence by exposure thereto. By way of example, in the field of the textile industry, in order to avoid summer heat, development of everyday clothes is waited which can intercept infrared rays in sunlight to restrain a rise in skin temperature, providing coolness to human bodies. Moreover, in the field of the construction industry, window glasses, curtains, etc. are developed which can shut out infrared rays in sunlight to restrain a rise in room temperature due to sunlight entering through windows.

Infrared rays result from not only the sun, but various artificial heat sources such as a blast furnace and a boiler, which are heated at several hundred to several thousand °C. Thus, in the field of the manufacturing industry, in view of severe work environments where the above heat sources are in operation, development of working clothes, etc. is waited which can shut out infrared rays resultant therefrom to reduce severeness of working conditions for operators.

In view of development of textile goods such as clothes and curtains which can intercept or shut out infrared rays, it is desirable that material fibers and cloths made by weaving the fibers serve essentially to intercept infrared rays. Conventionally, such fibers are obtained, e.g. by coating or laminating one side of unprocessed fibers with films of titanic or chromic oxide or metal such as gold or nickel having higher reflectivity through deposition or sputtering. With those fibers, reflection of infrared rays is not carried out by the fibers themselves, but by the films coated or laminated.

However, such known fibers having infrared-rays reflecting films coated or laminated and containing oxide or metal not only lack feeling and drapeability, but have a drawback in view of durability due to easy breakaway of the films by mechanical friction produced by washing, etc.

It is, therefore, an object of the present invention to provide a fiber structure which serves to efficiently intercept or shut out radiation in the infrared region, with excellent durability and easy manufacture and without any infrared-rays reflecting film coated or laminated.

Another object of the present invention is to provide cloths using the fiber structure and textile goods using such cloths.

SUMMARY OF THE INVENTION

One aspect of the present invention lies in providing a fiber structure with a cross section having x-axis and y-axis directions, comprising:

an alternate lamination including:

a first portion having a refractive index na and a thickness da; and a second portion adjacent to said first portion, said second portion having a refractive index nb and a thickness db, wherein when $1.0 \leqq na < 1.8$, $1.3 \leqq nb \leqq 1.8$, and $1.01 \leqq nb/na \leqq 1.80$, a primary peak wavelength $\lambda 1$ which is equal to 2(nada+nbdb) is given by $\lambda 1 \geqq 0.78$ ($\mu$m).

Another aspect of the present invention lies in providing a fiber structure with a cross section having x-axis and y-axis directions, comprising:

an alternate lamination including:

a first portion having a refractive index na and a thickness da; and a second portion adjacent to said first portion, said second portion having a refractive index nb and a thickness db, wherein when $1.0 \leqq na < 1.8$, $1.3 \leqq nb \leqq 1.8$, and $1.01 \leqq nb/na \leqq 1.80$, a primary peak wavelength $\lambda 1$ which is equal to 2(nada+nbdb) is given by $\lambda 1 \geqq 1.6$ ($\mu$m).

Still another aspect of the present invention lies in providing a cloth, comprising:

a fiber structure with a cross section having x-axis and y-axis directions, said fiber structure comprising:

an alternate lamination including:

a first portion having a refractive index na and a thickness da; and a second portion adjacent to said first portion, said second portion having a refractive index nb and a thickness db, wherein when $1.0 \leqq na < 1.8$, $1.3 \leqq nb \leqq 1.8$, and $1.01 \leqq nb/na \leqq 1.80$, a primary peak wavelength $\lambda 1$ which is equal to 2(nada+nbdb) is given by $\lambda 1 \geqq 0.78$ ($\mu$m).

A further aspect of the present invention lies in providing a textile product, comprising:

a cloth including a fiber structure with a cross section having x-axis and y-axis directions, said fiber structure comprising:

an alternate lamination including:

a first portion having a refractive index na and a thickness da; and a second portion adjacent to said first portion, said second portion having a refractive index nb and a thickness db, wherein when $1.0 \leqq na < 1.8$, $1.3 \leqq nb \leqq 1.8$, and $1.01 \leqq nb/na \leqq 1.80$, a primary peak wavelength $\lambda 1$ which is equal to 2(nada+nbdb) is given by $\lambda 1 \geqq 0.78$ ($\mu$m).

BRIEF DESCRIPTION OF THE DRAWINGS

FIG. 13 is a table illustrating the results of evaluation of examples relating to the first embodiment with respect to a reflection spectrum peak, etc.

DETAILED DESCRIPTION OF THE INVENTION

Figure 1A:
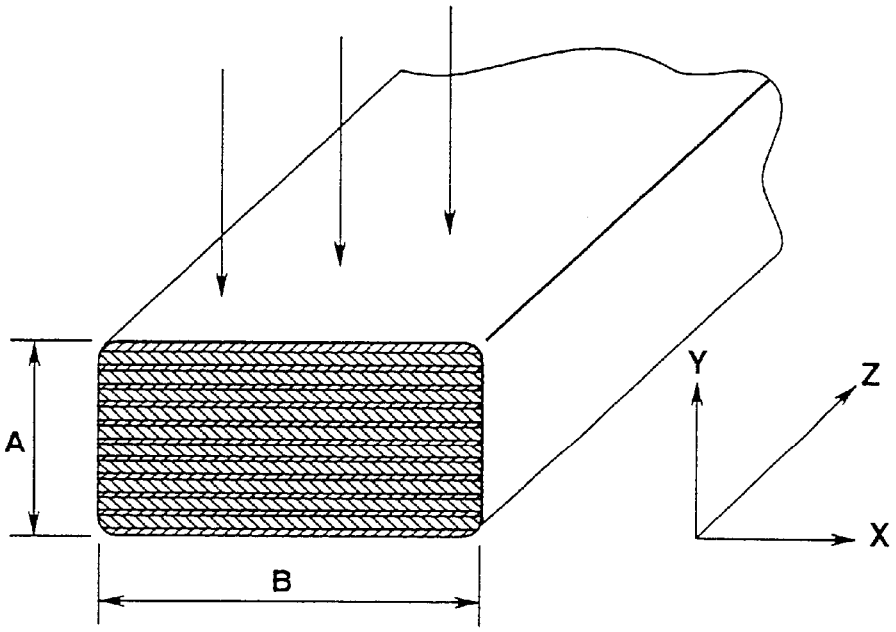
FIG. 1A is a perspective view showing a first embodiment of a fiber structure according to the present invention.

Referring to the drawings wherein like reference numerals designate like parts throughout the views, a description will be made with regard to preferred embodiments of a fiber structure, cloths using same, and textile goods.

FIGS. 1A–6 show a first embodiment of the present invention which relates to a fiber (referred hereafter to as "fiber structure") which serves to intercept or shut out by reflection, interference, etc. radiation in the infrared region, which results from heat sources such as the sun.

Referring to FIG. 1A, the fiber structure is a thread so called, and has a shape to extend in one-axis or Z-axis direction. The fiber structure is shaped flat so that a flattening ratio or ratio B/A of a length B of the fiber structure in the X-axis direction to a length A thereof in the Y-axis direction is 1 or more.

Figure 1B:
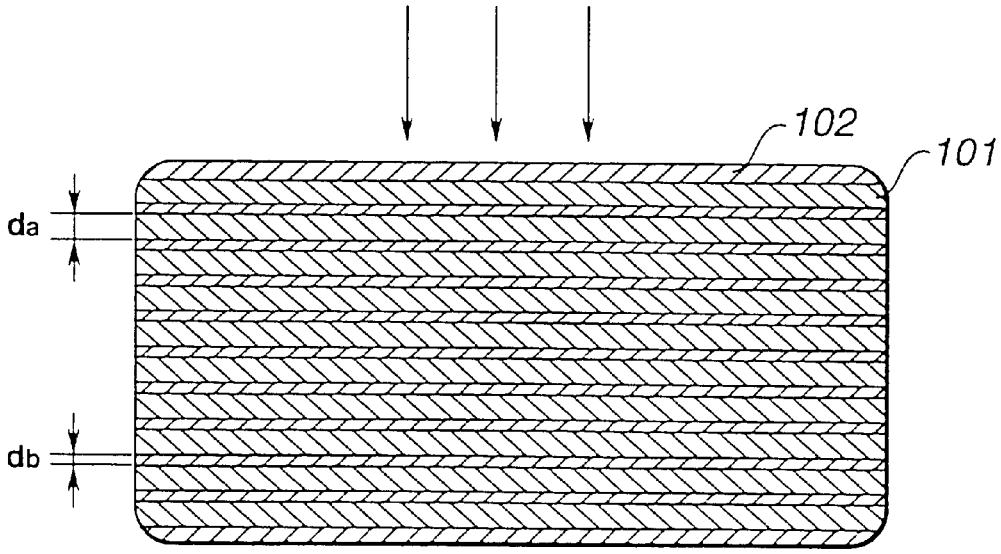
FIG. 1B is a cross section of the fiber structure.

The fiber structure includes a first material 101 with lower refractive index and a second material 102 with higher refractive index, which are laminated as shown in FIG. 1B, and extend continuously in the X-axis direction or in the Z-axis direction. The fiber structure efficiently reflects radiation in the infrared region based on interference ensured by lamination of the materials 101, 102.

The first and second materials 101, 102 include, preferably, materials which can be spun in the ordinary spinning process. Further, since radiation needs to enter lamination of the materials 101, 102 for production of interference, the materials 101, 102 have, preferably, a certain translucency with respect to at least radiation with wavelength to be reflected. Furthermore, the materials 101, 102 have, preferably, some or more translucency with respect to radiation in the visible region in view of possibility of adding the function of reflecting radiation with a predetermined wavelength in the visible region.

Materials which meet such requirements include thermoplastic polymer resins with translucency, including polyethylene terephthalate, polybutylene terephthalate, and polyethylene naphthalate; and polyester, polyacrylonitrile, polystyrene, polyamide such as nylon-6 or nylon-66, polypropylene, polyvinyl alcohol, polycarbonate, polymethyl methacrylate, polyether etherketone, polyparaphenylene terephthal amide, polyphenylene sulfide, etc., which are obtained by denaturing the above three by third components, respectively. Moreover, such materials include mixtures of two or more of the above polymer resins, and copolymer resins thereof.

When compatibility of polymer resins of the materials 101, 102 is not favorable, breakaway of the two may occur, becoming of no practical use. In that case, it is preferable to add a compatible agent to one or both of the materials 101, 102 or copolymerize the two to improve compatibility thereof.

Moreover, the materials 101, 102 can contain known modifier and function such as antioxidant, stabilizer, dispersion assistant, flame retardant, and antibacterial agent.

The materials 101, 102 are selected from the above polymer resins to form lamination as shown in FIGS. 1A–1B. Specifically, suppose that in a section taken perpendicularly with respect to the longitudinal direction of the fiber structure or the Z-axis direction, the X axis extends parallel to the materials 101, 102, and the Y axis extends perpendicular thereto. The materials 101, 102 are laminated in the Y-axis direction. Suppose that radiation is incident on the fiber structure to correspond to the direction of lamination of the materials 101, 102 or the Y-axis direction.

Suppose that the first material 101 has a refractive index na and a thickness da, and the second material 102 has a refractive index nb and a thickness db. Using the sum (nada+nbdb) of the optical thicknesses of the materials 101, 102, $\lambda 1$ is given by:

$$\lambda 1=2(nada+nbdb) \quad (1)$$

Note that in the formula of interference of light which is applicable to a multilayer structure, $\lambda 1$ designates a primary peak wavelength in the reflection spectrum of the laminated films.

In the first embodiment, in order to effectively reflect infrared rays, $\lambda 1$ is set to 0.78 $\mu$m or more which is a boundary value between the visible region and the infrared region.

As disclosed in JP-A 7-195603, the teachings of which are hereby incorporated by reference, even with $\lambda 1$ having a value in the visible region, i.e. less than 0.78 $\mu$m, a certain reflectivity can be obtained in the near infrared region by increasing the ratio of the refractive index of the second material to that of the first material, or the number of laminated materials. However, setting of $\lambda 1$ in the infrared region in the way as described above enables, with less number of laminated materials, effective reflection of infrared rays in a wider extent of wavelength including the near infrared region.

Setting of $\lambda 1$ to 0.78 $\mu$m or more needs appropriate selection of the refractive indexes na, nb and thicknesses da, db of the first and second materials 101, 102.

An average refractive index n of the above polymer resins at the ambient temperature is generally between 1.3 and 1.8, and practically between 1.45 and 1.70. It will be thus understood that the refractive indexes na, nb of the first and second materials 101, 102 are in such range, respectively.

Regarding the order of laminating the first and second materials 101, 102, though reflection of infrared rays can be obtained regardless of which material is placed outermost, the material with higher refractive index and reflectivity forms, preferably, an outer surface which directly receives infrared rays.

As shown in FIGS. 1A–1B, the section of the fiber structure including lamination of the materials 101, 102 is shaped in a rectangle with a short side extending in the direction of incident radiation or the Y-axis direction, which ensures a wider area for receiving infrared rays, enabling efficient reflection thereof.

Figure 2A:
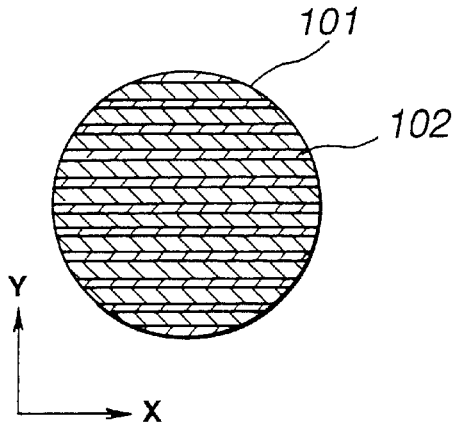
FIGS. 2A–2C are views similar to FIG. 1B, showing variants of the first embodiment with regard to the shape of the section.
Figure 2B:
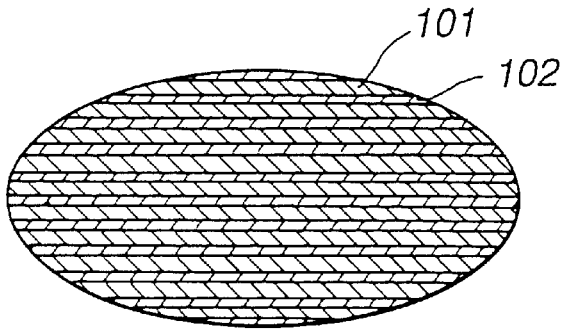
Figure 2C:
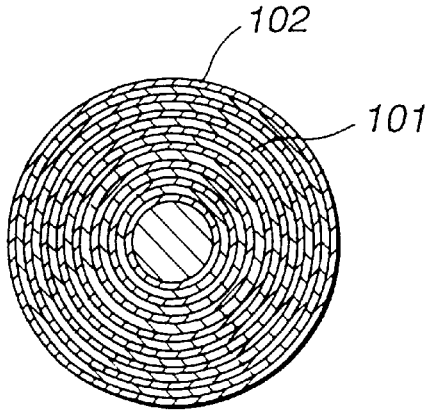

FIGS. 2A–2C show variants of the first embodiment, wherein the section of the fiber structure is shaped in different forms. The section of the fiber structure may be shaped in a circle as shown FIG. 2A, or in an ellipse with a major axis extending in the X-axis direction as shown in FIG. 2B. With the fiber structure with circular section, the first and second materials 101, 102 may be laminated concentrically as shown in FIG. 2C.

Figure 3A:
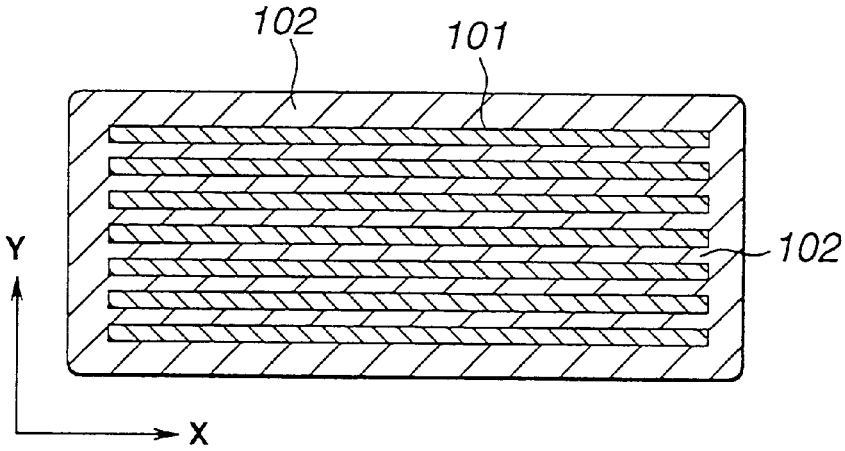
FIGS. 3A–3C are views similar to FIG. 2C, showing other variants of the first embodiment, which include a protective layer around alternate lamination.
Figure 3B:
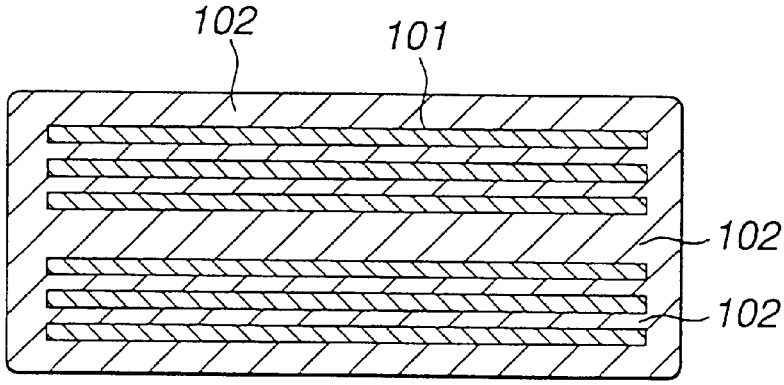
Figure 3C:
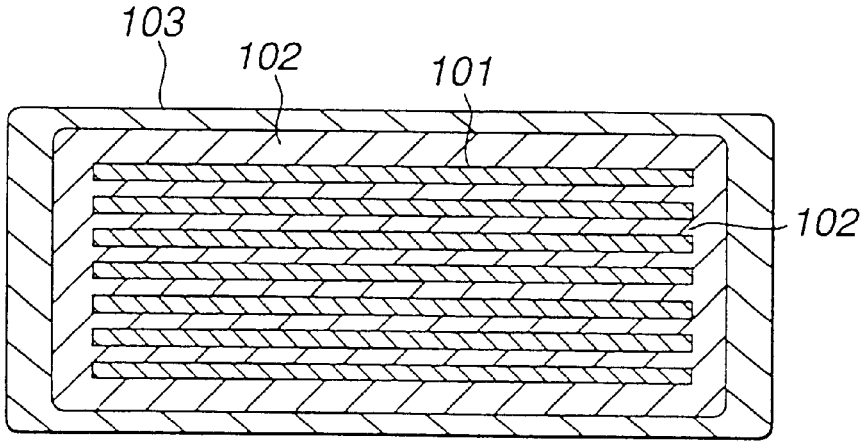

FIGS. 3A–3C show other variants of the first embodiment, wherein a protective layer is arranged around lamination of the first and second materials 101, 102 to prevent breakaway of the two and improve the mechanical strength. The protective layer may be formed out of the same material as that of the first material 101 or the second material 102 as shown in FIGS. 3A–3B, or a third material 103 different therefrom as shown in FIG. 3C. Moreover, the protective layer may be formed in a multilayer structure having two or more laminated layers to obtain improved optical and mechanical functions thereof.

Figure 4A:
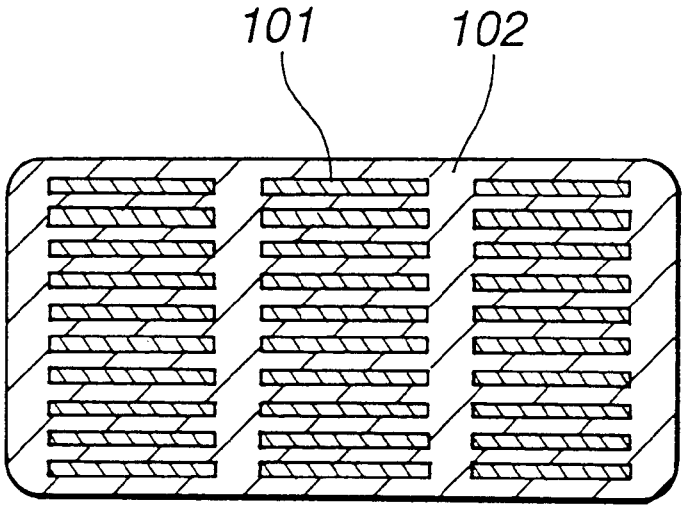
FIGS. 4A–4B are views similar to FIG. 3C, showing further variants of the first embodiment, which include alternate lamination formed discontinuously or partly.
Figure 4B:
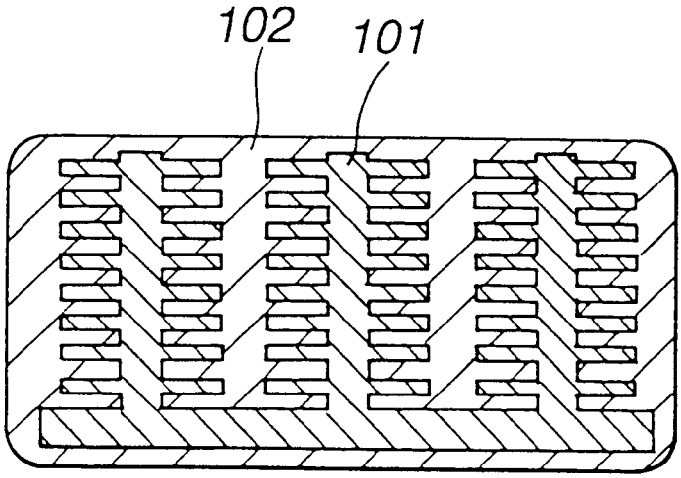

FIGS. 4A–4B show further variants of the first embodiment, wherein lamination of the materials 101, 102 is formed discontinuously or partly. The first material 101 may extend discontinuously or have interrupted portions by the second material 102 in the X-axis direction as shown in FIG. 4A. That is, groups of laminations of the first and second materials 101, 102 may be formed in the second material 102. Moreover, each group of laminations of the first and second materials 101, 102 may include a base extending in the X-axis direction for supporting the groups of laminations of the first and second materials 101, 102, and a midrib extending in the Y-axis direction for supporting lamination of the first material 101 as shown in FIG. 4B. A structure having a midrib and parallel fins is called "lamellar ridge structure" among us.

Note that in the fiber structures as shown in FIGS. 4A–4B, as the shortest width of the first material 101 in the X-axis direction approaches the wavelength of incident radiation, scattering of radiation is greater, obtaining difficultly a desired interference. In view of this, the shortest width of the first material 101 in the X-axis direction should be greater than $\lambda 1$.

Figure 5A:
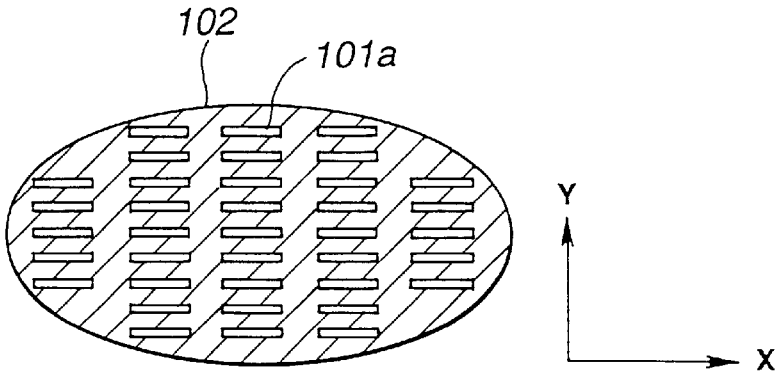
FIGS. 5A–5C are views similar to FIG. 4B, showing still further variants of the first embodiment, which include an air layer.
Figure 5B:
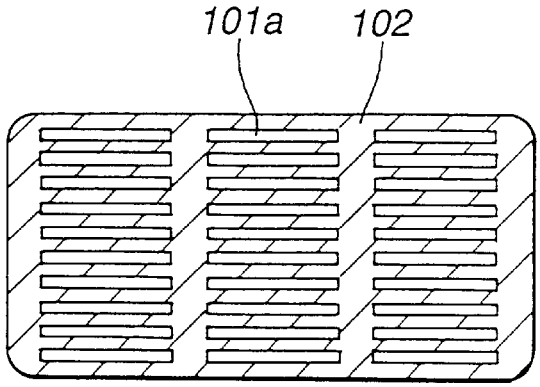
Figure 5C:
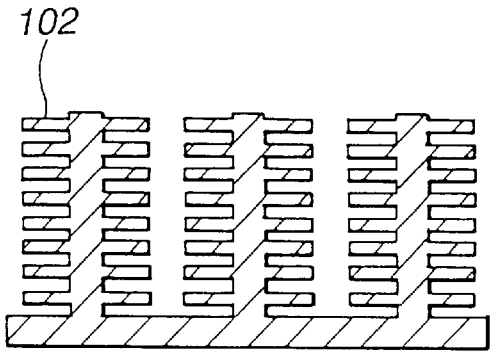

FIGS. 5A–5C show still further variants of the first embodiment, wherein a first material 101*a* includes air in place of the polymer resin. The refractive index of the polymer resin is 1.3 or more as described above, while the refractive index of air is smaller, i.e. about 1.0. Thus, as will be seen from FIG. 6, the use of air as a material with lower refractive index allows easy increase in the refractive-index ratio nb/na of the two laminated material. Moreover, this allows an increase in the number of polymer resins which can be selected as a material with higher refractive index.

When selecting air as the first material 101*a*, the section of the fiber structure may be as shown in FIGS. 5A–5C. In those variants, due to the fact that air cannot support another material, the first material 101*a* including air is arranged discontinuously in the X-axis direction in the second material 102 including the polymer resin as shown in FIGS. 5A–5B. Alternatively, the lamellar ridge structure may be formed only by the second material 102 as shown in FIG. 5C, which enables practical achievement of lamination of the first material 101*a* or air and the second material 102.

Moreover, due to the fact that air is low in heat conductivity, the use of the first material 101*a* or air adds heat insulation to the fiber structure, which cooperates with reflection of infrared rays to increase a heat interception effect thereof.

In such a way, in the first embodiment, the fiber structure includes the first material selected from the polymer resins and air, and the second material selected from the polymer resins and having higher refractive index than that of the first material.

Since the refractive index of air is about 1.0, and the refractive index of the polymer resins is generally between 1.3 and 1.8 as described above, the range of the refractive index na which can be taken by the first material is given by:

$$1.0 \leqq na < 1.8 \quad \text{(a)}$$

On the other hand, the range of the refractive index nb of the second material selected from the polymer resins and having higher refractive index than that of the first material is given by:

$$1.3 \leqq nb < 1.8 \quad \text{(b)}$$

In addition to the aforementioned polymer resins, polymer resins which are appropriate to the first material with lower refractive index ($n \leqq 1.4$) include fluorine resins such as polytetrafluoroethylene (PTFE) and fluoroetylene-polypropylene (FEP). Moreover, polymer resins which are appropriate to the second material with higher refractive index ($n \geqq 1.6$) include polyvinylidene chloride (PVDC), polyvinylidene fluoride (PVDF), the aforementioned polyester resins, and polyphenyl sulfide (PPS).

Figure 6:
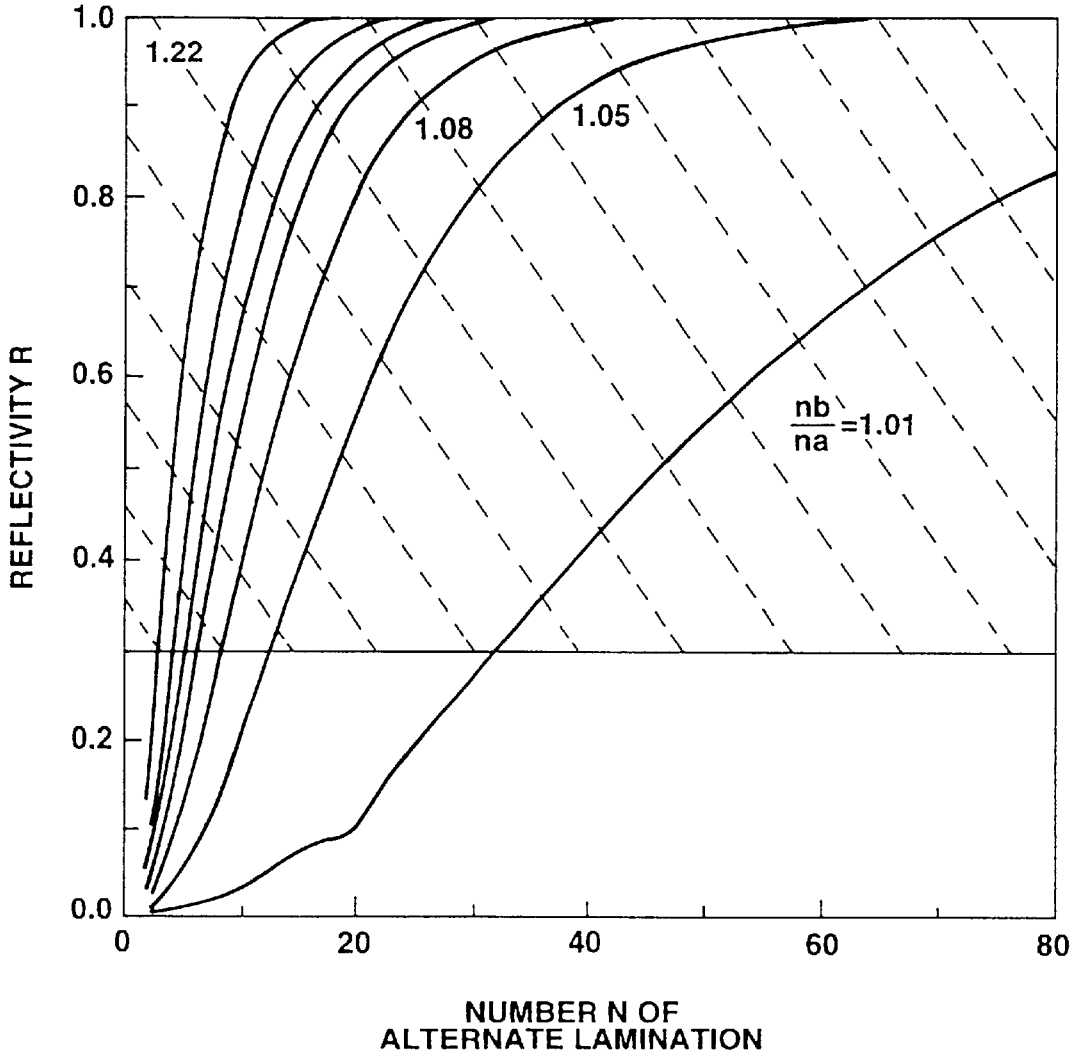
FIG. 6 is a graph illustrating the relationship between the number of alternate laminations and the refractivity.

FIG. 6 shows the relationship between the number N of alternate laminations of the first and second materials and the refractivity R. The ratio nb/na of the refractive index nb of the second material to the refractive index na of the first material forms a parameter. Note that the number N of alternate laminations is given in pitches, one pitch corresponding to a combination of one first material and one second material. The number N of alternate laminations and the reflectivity R are obtained by simulation with the primary peak wavelength $\lambda 1$ in the reflection spectrum being 1 $\mu$m.

Generally speaking, textile goods provide coolness when an average reflectivity of infrared rays is about 30% or more. A hatched area in FIG. 6 shows a reflectivity of 30% or more. FIG. 6 reveals that the larger is the number N of alternate laminations, the higher is the reflectivity R. Moreover, it reveals that with the same number N of alternate laminations, the larger is the ratio nb/na of the refractive index nb of the second material to the refractive index na of the first material, the higher is the reflectivity R.

However, in view of difficulty of the fiber spinning process when increasing the number N of alternate laminations, the number N is restrained, preferably, to a predetermined value by increasing the refractive-index ratio nb/na. As will be seen from FIG. 6, with the refractive-index ratio nb/na less than 1.01, the number N of alternate laminations amounts to a considerable value to obtain a reflectivity of 30% or more, complicating the structure of spinnerets extremely, resulting in difficult achievement of uniform thickness of lamination layers. It will be thus understood that the refractive-index ratio nb/na is, preferably, at least 1.01 or more.

Moreover, as the refractive-index ratio nb/na infinitely approaches 1.00, a variation in the refractive-index ratio is produced due to fluctuation of the refractive index and wavelength which result from slight environmental variations. As a consequence, the increased number N of alternate lamination does not ensure stable reflection and interference. It will be understood from this that the refractive-index ratio nb/na is, preferably, at least 1.01 or more.

Experience reveals that in view of easy manufacture of the fiber structure, the refractive-index ratio nb/na is, preferably, between 1.03 and 1.05.

Moreover, in view of the ranges of the refractive indexes na, nb, the maximum value of the refractive-index ratio nb/na is 1.80. Thus, the range of the refractive-index ratio nb/na is given by:

$$1.01 \leqq nb/na \leqq 1.80 \quad (c)$$

As described above, in the first embodiment, the fiber structure includes the first and second materials which are laminated as viewed in the cross section. When the first material has the refractive index na and the thickness da, and the second material has the refractive index nb and the thickness db, the following conditions are satisfied:

$$1.0 \leqq na < 1.8 \quad (a)$$

$$1.3 \leqq nb < 1.8 \quad (b)$$

$$1.01 \leqq nb/na \leqq 1.80 \quad (c)$$

The primary peak wavelength λ1 in the reflection spectrum is given by:

$$\lambda 1 = 2(nada + nbdb) \quad (1)$$

where $$\lambda 1 \geqq 0.78\ \mu m \quad (2)$$

The infrared spectrum of sunlight exists continuously from 0.78 to about 5.00 μm, showing high energy, particularly, in the near infrared region ranging from 0.78 to 2.00 μm. Thus, in order to intercept infrared rays in sunlight, the primary peak wavelength λ1 in the reflection spectrum is determined between 0.78 and about 5.00 μm and, preferably, between 0.78 and 2.00 μm.

When manufacturing cloths by weaving the fiber structure of the present invention, more effective reflection of infrared rays is obtained by determining the direction of the thread or fiber structure so that lamination of the first and second materials is perpendicular to the surface of the cloths.

Further, the fiber structure of the present invention can be mixed with the aforementioned known fibers which can intercept infrared rays to manufacture fiber structures such as woven and non woven fabrics.

Furthermore, cloths using the fiber structure of the present invention can be applied to summer goods such as blouses, shirts, suits, sport clothes, hats, and parasols, which effectively intercept or shut out infrared rays in sunlight, providing coolness to human bodies. Moreover, such cloths can be applied to interior and vehicular goods such as curtains, blind slats, seat cover, enabling restraint of a temperature rise in rooms and cabins.

FIGS. 1A–4B also show a second embodiment of the present invention which is substantially the same as the first embodiment, but relates to the fiber structure which serves to effectively intercept or shut out by reflection, interference, etc. radiation in the infrared region, which results principally from artificial heat sources arranged in work environments.

The fiber structure of the second embodiment also includes first and second materials laminated as shown in FIGS. 1A–4B. The materials include the thermoplastic polymer resins as described in the first embodiment. Note that the first material with lower refractive index may include air in place of the polymer resin.

As described in the first embodiment, infrared rays resultant from the sun are principally radiation in the near infrared region ranging from 0.78 to 2.00 μm. On the other hand, infrared rays resulting from artificial heat sources such as a blast furnace and a heater are radiation in the infrared region covering greater wavelength. By way of example, in work environments where various heat sources heated at several hundred to several thousand °C. are in operation, infrared rays resultant from such heat sources are principally slightly greater in wavelength than those resultant from the sun.

Generally, as is known from the StefanBoltzmann's law and the Wien's displacement law, the temperature of a heated body defines the intensity and wavelength of infrared rays. By way of example, a heat source of about 300° C. emits infrared rays with wavelength of about 5.0 μm the most intensely, whereas a heat source of about 1,000° C. emits infrared rays with wavelength of about 2.3 μm the most intensely. The artificial heat sources emit generally the infrared spectrum ranging from 1.6 to 20.0 μm.

The fiber structure of the second embodiment, which includes the same lamination as that of the first embodiment, has the primary peak wavelength λ1 equal to and more than 1.6 μm to effectively reflect infrared rays in the work environments.

Specifically, in the second embodiment, the fiber structure includes the first and second materials which are laminated as viewed in the cross section. When the first material has the refractive index na and the thickness da, and the second material has the refractive index nb and the thickness db, the following conditions are satisfied:

$$1.0 \leqq na < 1.8 \quad (a)$$

$$1.3 \leqq nb < 1.8 \quad (b)$$

$$1.01 \leqq nb/na \geqq 1.80 \quad (c)$$

The primary peak wavelength λ1 in the reflection spectrum is given by:

$$\lambda 1 = 2(nada + nbdb) \quad (1)$$

where $$\lambda 1 \geqq 1.6\ \mu m \quad (3)$$

When manufacturing cloths by weaving the fiber structure of the present invention, more effective reflection of infrared rays is obtained by determining the direction of the thread or fiber structure so that lamination of the first and second materials is perpendicular to the surface of the cloths. Working goods such as working clothes and protective covers manufactured from such cloths serve to effectively intercept or shut out infrared rays emitted from heat sources by reflection, restraining a temperature rise of human bodies and object, thus providing coolness to human bodies.

Regarding clothing manufactured from cloths which serve to reflect infrared rays with greater wavelength or far infrared rays so called, it can reflect and shut therein infrared rays emitted from human bodies. Therefore, when the ambient temperature is extremely low, such clothing can produce a heat insulation effect.

FIGS. 7A–7D show a third embodiment of the present invention which relates to a combined fiber structure including a first fiber structure selected from the fiber structures as described in the first and second embodiments, and a second fiber structure selected from a fiber structure for reflecting visible rays by reflection and interference and a fiber structure for reflecting ultraviolet rays.

Figure 7A:
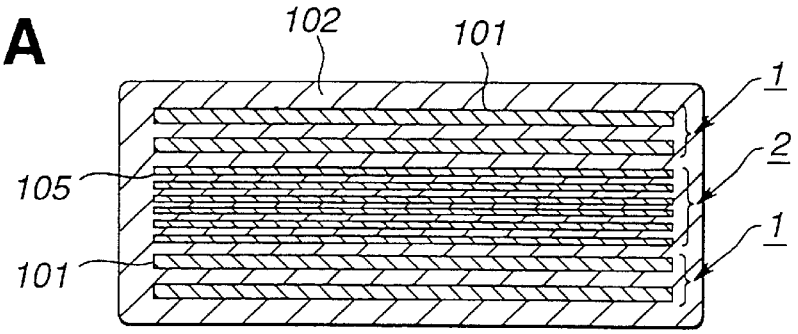
FIGS. 7A–7D are views similar to FIG. 5C, showing a third embodiment of the present invention.

Referring to FIG. 7A, the combined fiber structure includes two first fiber structures 1 for reflecting infrared rays, and a second fiber structure 2 interposed therebetween for reflecting visible rays or ultraviolet rays. The first fiber structure 1 includes a first material 101 and a second material 102, whereas the second fiber structure 2 includes a first material 105 and a second material 102 which is common to the first fiber structure 1. Moreover, the combined fiber structure includes a protective layer arranged around the fiber structures 1, 2 and formed out of the material 102 which is used in the first and second fiber structures 1, 2.

Figure 7B:
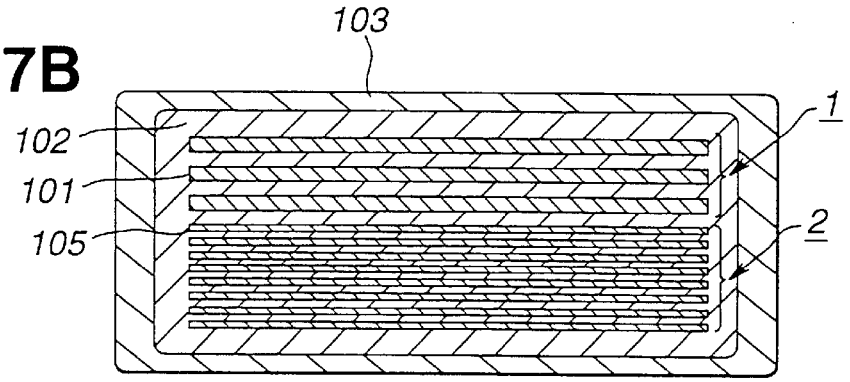

Referring to FIG. 7B, the combined fiber structure includes a first fiber structure 1 for reflecting infrared rays, and a second fiber structure 2 arranged parallel thereto for reflecting visible rays or ultraviolet rays. Moreover, the combined fiber structure includes a protective layer arranged around the fiber structures 1, 2 and formed out of a third material 103 which is different from materials of the first and second fiber structures 1, 2.

Figure 7C:
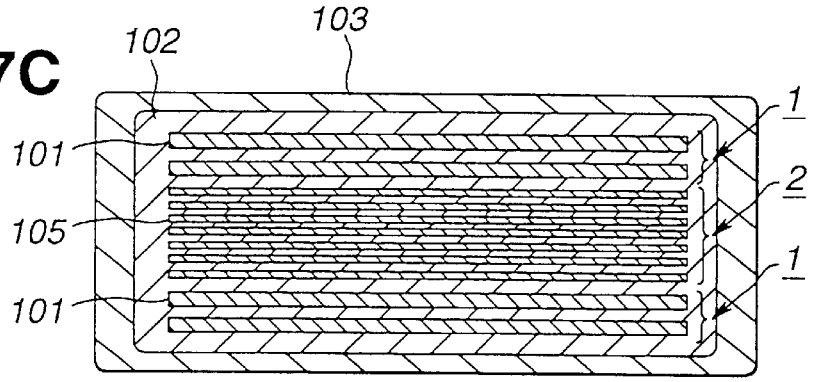
Figure 7D:
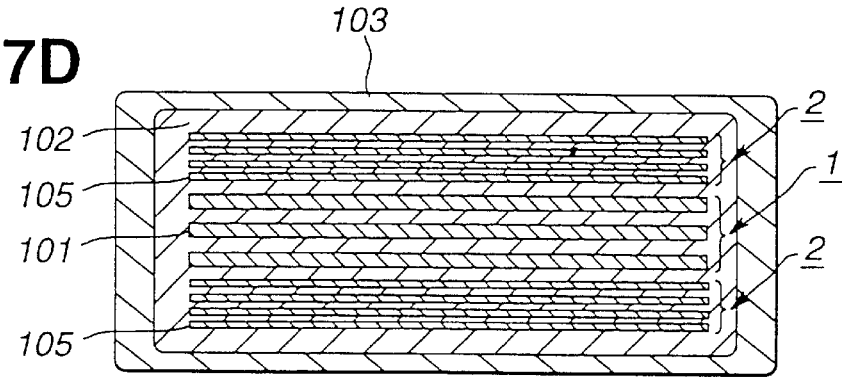
Figure 8A:
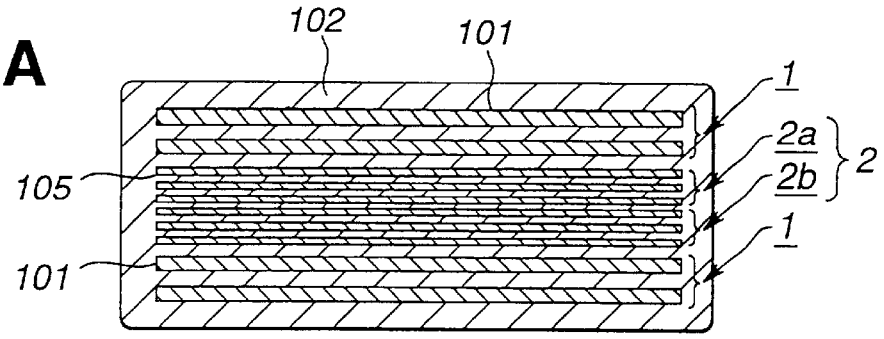
FIGS. 8A–8D are views similar to FIG. 7D, showing variant of the third embodiment, which include a combined fiber structure.
Figure 8B:
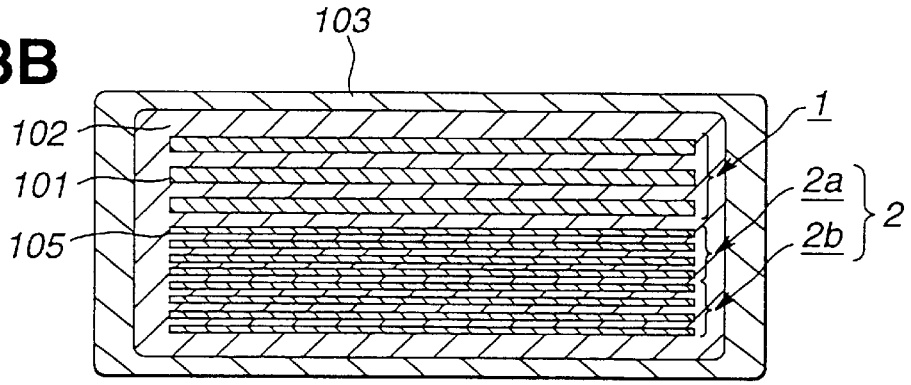
Figure 8C:
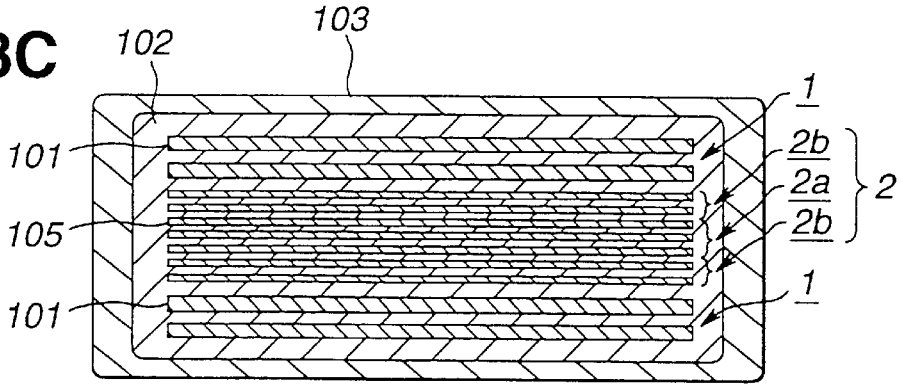
Figure 8D:
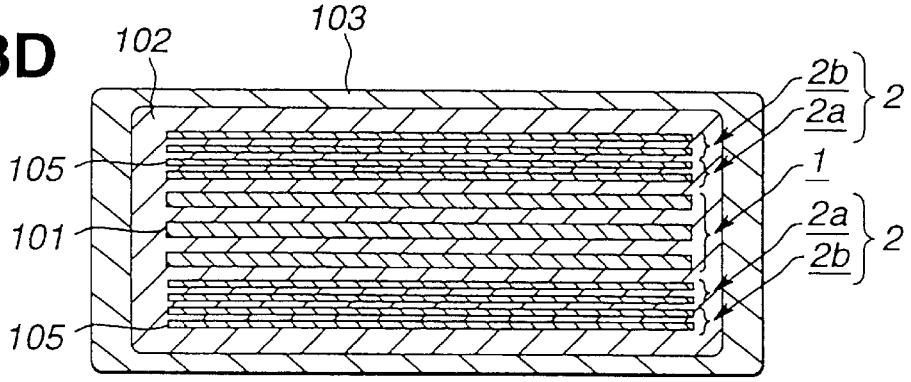

Referring to FIG. 7C, the combined fiber structure includes a protective layer arranged around the combined fiber structure as shown in FIG. 7A and formed out of the third material 103. Referring to FIG. 7D, the combined structure includes two second fiber structures 2 for reflecting visible rays or ultraviolet rays, a first fiber structure 1 interposed therebetween for reflecting infrared rays, and a protective layer arranged around the first and second fiber structures 1, 2 and formed out of the third material 103.

The fiber structure for ensuring reflection and interference of radiation in the visible region, which is disclosed, e.g. in JP-A 6-17349 and JP-A 7-34324, can be designed concretely in accordance therewith. By way of example, when one of two materials of such fiber structure has a refractive index nc and a thickness dc, and another of which has a refractive index ne and a thickness de, the following conditions are satisfied:

$$1.3 \leqq nc \quad (a')$$

$$1.1 \leqq ne/nc \leqq 1.4 \quad (b')$$

A primary peak wavelength λ2 in the reflection spectrum is given by:

$$\lambda 2 = 2(ncdc + nede) \quad (4)$$

where λ2 is determined to a wavelength (about 0.40 to about 0.78 μm) in the visible region. Radiation in the visible region, of which the fiber structure ensures reflection and interference, is sensed by human eyes as "colors". That is, the fiber structure for ensuring reflection and interference of radiation in the visible region serves as a "coloring fiber".

On the other hand, the fiber structure for reflecting ultraviolet rays, which is disclosed, e.g. in JP-A 7-195603, can be designed concretely in accordance therewith. By way of example, when one of two materials of such fiber structure has a refractive index nf and a thickness df, and another of which has a refractive index ng and a thickness dg, the following conditions are satisfied:

$$1.0 \leqq nf \leqq 1.8 \quad (c')$$

$$1.3 \leqq ng \leqq 1.8 \quad (d')$$

$$1.25 \leqq ng/nf \leqq 1.80 \quad (e')$$

A primary peak wavelength λ3 in the reflection spectrum is given by:

$$\lambda 3 = 2(nfdf + ngdg) \quad (5)$$

where λ3 is determined to a wavelength (less than about 0.4 μm) in the ultraviolet region. The fiber structure for reflecting ultraviolet rays serves to intercept ultraviolet rays which are harmful to a human skin.

In the third embodiment, in order to prevent breakaway of lamination layers and wear of the entirety, the combined fiber structure includes, preferably, the protective layer arranged around the first and second fiber structures 1, 2 as shown in FIGS. 7A–7D. As described above, the protective layer may be formed out of the material 102 used in the fiber structures 1, 2 or the third material 103 different from the materials thereof.

In the third embodiment, the section of the combined fiber structure is shaped in a rectangle as shown in FIGS. 7A–7D. Aternatively, it may be shaped in other forms such as circle, square, and triangle.

In the third embodiment, the second fiber structure 2 is selected from the fiber structure for reflecting visible rays by reflection and interference and a fiber structure for reflecting ultraviolet rays. Alternatively, the fiber structure 2 may include both of the two fiber structures as shown in FIGS. 8A–8D. In those variants, referring to FIGS. 8A–8D, a combined fiber structure comprises a first fiber structure 1 and a second fiber structure 2 including a first portion 2*a* for reflecting ultraviolet rays and a second portion 2*b* for reflecting visible light.

According to the third embodiment, the combined fiber structure not only provides coolness to human bodies, but produces bright and transparent tone and visual quality peculiar to an interference color or reflects ultraviolet rays harmful to a human skin, forming a undyed high-functional fiber.

Figure 9A:
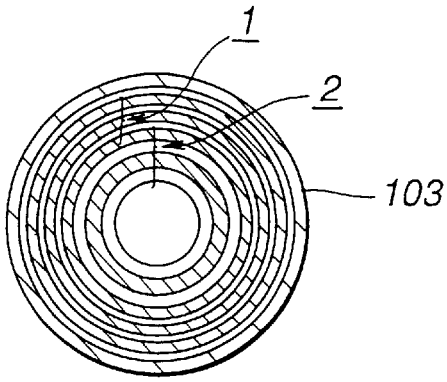
FIGS. 9A–9C are views similar to FIG. 8D, showing a fourth embodiment of the present invention.
Figure 9B:
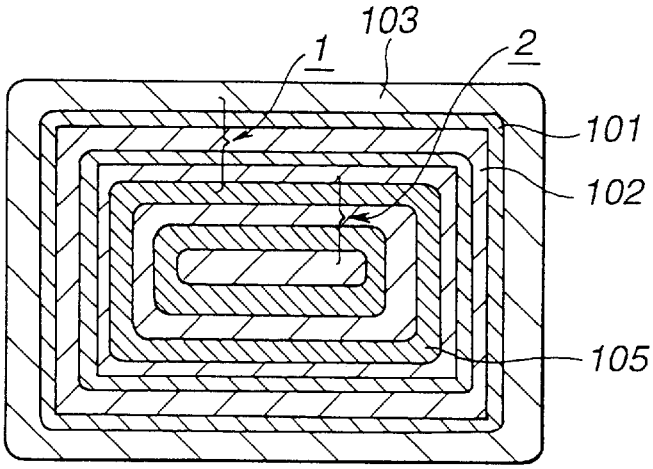
Figure 9C:
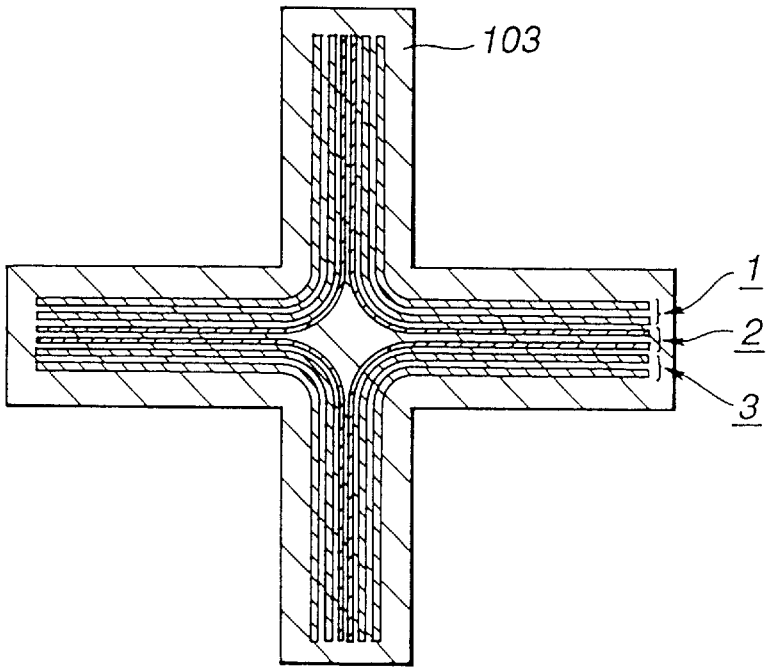

FIGS. 9A–9C show a fourth embodiment of the present invention which is substantially the same as the third embodiment, but relates to a combined fiber structure which can produce the functions of the fiber structures 1, 2 in all directions.

Referring to FIG. 9A, the combined fiber structure has a circular section, and includes a first fiber structure 1 for reflecting infrared rays and a second fiber structure 2 selected from a fiber structure for reflecting visible rays by reflection and interference and a fiber structure for reflecting ultraviolet rays, the first and second fiber structures 1, 2 being arranged concentrically. Moreover, the combined fiber structure includes a protective layer arranged around the fiber structures 1, 2 and formed out of a third material 103.

Referring to FIG. 9B, the combined fiber structure has a rectangular section, and includes first and second fiber structures 1, 2 shaped like a rectangular frame and arranged in a nest-like way, and a protective layer arranged therearound and formed out of the third material 103. Referring to FIG. 9C, the combined fiber structure has a cross-shaped section, and includes first and second fiber structures 1, 2 united each other, and a protective layer arranged therearound and formed out of the third material 103.

In the fourth embodiment, the combined fiber structure is constructed such that lamination layers of the first and second fiber structures 1, 2 are parallel to the outer periphery of the combined fiber structure, ensuring substantially the same reflection and interference in the cross section with respect to radiation incident from any direction. That is, the combined fiber structure can ensure not only reflection of infrared rays obtained by the first fiber structure 1, but coloring or reflection of ultraviolet rays obtained by the second fiber structure 2 with respect to radiation in all directions.

In the fourth embodiment, in order to prevent breakaway of lamination layers and wear of the entirety, the combined fiber structure includes, preferably, the protective layer arranged around the first and second fiber structures 1, 2 as shown in FIGS. 9A–9C. As described above, the protective layer may be formed out of the material 102 used in the fiber structures 1, 2 or the third material 103 different from the materials thereof. The material of the protective layer has, preferably, greater transmittance to obtain effective reflection of infrared rays and reflection and interference of visible rays.

In the fourth embodiment, the section of the combined fiber structure is shaped as shown in FIGS. 9A–9C. Alternatively, it may be shaped in other forms on condition that lamination layers of the first and second fiber structures 1, 2 are parallel to the outer periphery of the combined fiber structure.

According to the fourth embodiment, the combined structure is constructed such that lamination layers of the first and second fiber structures 1, 2 are parallel to the outer periphery of the combined fiber structure, forming a undyed high-functional fiber which can ensure not only reflection of infrared rays, but coloring or reflection of ultraviolet rays with respect to radiation in all directions.

Regarding cloths manufactured by using as warp and weft the combined fiber structure of the present invention in the form of a twisted or non-twisted thread, such cloths produce substantially the same function as that of the combined fiber structure in all directions, not only providing coolness to human bodies, but producing bright tone or reducing harmful ultraviolet rays.

Finally, a fifth embodiment of the present invention will be described, which relates to a ceramic fiber structure obtained by adding ceramic particulates with higher reflection characteristic in the infrared region to the fiber structure as described in the first or second embodiment.

Ceramics for reflecting radiation in the infrared region include transition elements forming group 4 of the periodic table such as titanium (Ti), zirconium (Zr) and hafnium (Hf), and carbide or oxide of silicon (Si), boron (B), tantalum (Ta), etc. The ceramic fiber structure can contain one or more of the above ceramics.

The method of adding ceramic particulates to the fiber structure is somewhat different in accordance with polymer resins applied. However, the known methods can be applied fundamentally, such as method of adding ceramic particulates to a melted polymer and method of adding ceramic particulates in the polymerization process.

By way of example, when using thermoplastic polymer resins such as polyester, the applicable methods are: method of adding ceramic particulates in the polymerization process, method of kneading ceramic particulates in the form of master pellets with a base polymer, method of adding a slurry additive obtained by previously mixing ceramic particulates with a melted polymer or a dispersion medium compatible with a polymer and pellets to be supplied to a spinning machine, etc.

An average diameter of ceramic particulates to be added to a polymer resin, which is variable with the sectional area of the fiber structure and the thickness of each lamination layer thereof, is, preferably, less than 1.0 $\mu$m, particularly, less than 0.5 $\mu$m.

The content of ceramic particulates exceeding 30% by weight makes fiberization using the spinning process difficult, and fiber property inferior. In view of achievement of stable fiberization and improved infrared-rays reflection characteristic due to ceramic particulates added, the content of ceramic particulates is between 0.1 and 30.0% by weight, preferably, between 1.0 and 10.0% by weight.

Addition of ceramic particulates having infrared-rays reflection effect contributes to a further increase in infrared-rays interception effect of the fiber structure. Ceramic particulates can reflect infrared rays regardless of the direction of incident radiation, so that even with lamination of the fiber structure slightly displaced with respect to incident radiation, the fiber structure can ensure reflection of infrared rays to a certain extent.

Known achievement of no small reflection of infrared rays only by ceramic particulates added to a fiber base requires a considerably increased amount of ceramic particulates, resulting often in difficult fiberization. On the other hand, according to the fifth embodiment of a fiber structure, the content of ceramic particulates can be determined in view of favorable fiberization.

Cloths manufactured from the fiber structure containing ceramic particulates and textile goods using such cloths can effectively intercept or shut out infrared rays to provide coolness to human bodies.

Since most of the ceramic particulates can emit infrared rays efficiently, clothing using the above fiber structure not only provide coolness, but ensure heat retaining.

The fiber structures of the present invention can be manufactured in accordance with the known manufacturing methods of composite fibers. By way of example, the fiber structures as shown in FIGS. 2B–2C are obtained such that two polymers are passed through a static mixer with a predetermined number of elements in a spinning pack, which is then guided by a flow divided plate and extruded from a spinneret inlet opening. The static mixer includes mixers disclosed, e.g. in JP-B2 60-1048 and connected to each other to form joined multilayer composite-polymer flow. An oval slit is adopted for the fiber structure as shown in FIG. 2B, whereas a circular slit is adopted for the fiber structure as shown in FIG. 2C.

In order to obtain stable and effective reflection and interference of radiation with a predetermined wavelength, a spinneret for spinning a composite polymer fiber as disclosed, e.g. in JP 9-133038 and JP 133040 is, preferably, arranged in the spinning pack. Such spinneret enables achievement of the fiber structures having lamination and protective layer as shown in FIGS. 3A–3C.

Next, examples will be described which correspond to the first to fifth embodiments of the present invention.

An example 1 corresponding to the first embodiment will be described, wherein the first material includes polymethyl methacrylate (PMMA), and the second material includes polyethylene terephthalate (PET). The refractive index na of the first material of PMMA is 1.49, and the refractive index nb of the second material of PET is 1.60. The thickness da of the first material or one PMMA layer is 0.168 $\mu$m, and the thickness db of the second material or one PET layer is 0.156 $\mu$m. Thus, $\lambda 1$ given by the formula (1) in the first embodiment is determined to about 1.0 $\mu$m.

Using a spinneret as disclosed in U.S. patent application Ser. No. 08/602,057, composite spinning is carried out at a spinning temperature of 285° C. to obtain the fiber structure with a rectangular section as shown in FIG. 1B and the number N of alternate laminations of 15 pitches. The flattening ratio or ratio B/A of the length B of the fiber structure in the X-axis direction to the length A thereof in the Y-axis direction is 4.5.

Using filaments of the fiber structure as warp and weft, a plain weave is manufactured with warp density of 120/in. and weft density of 90/in.

Figure 10:
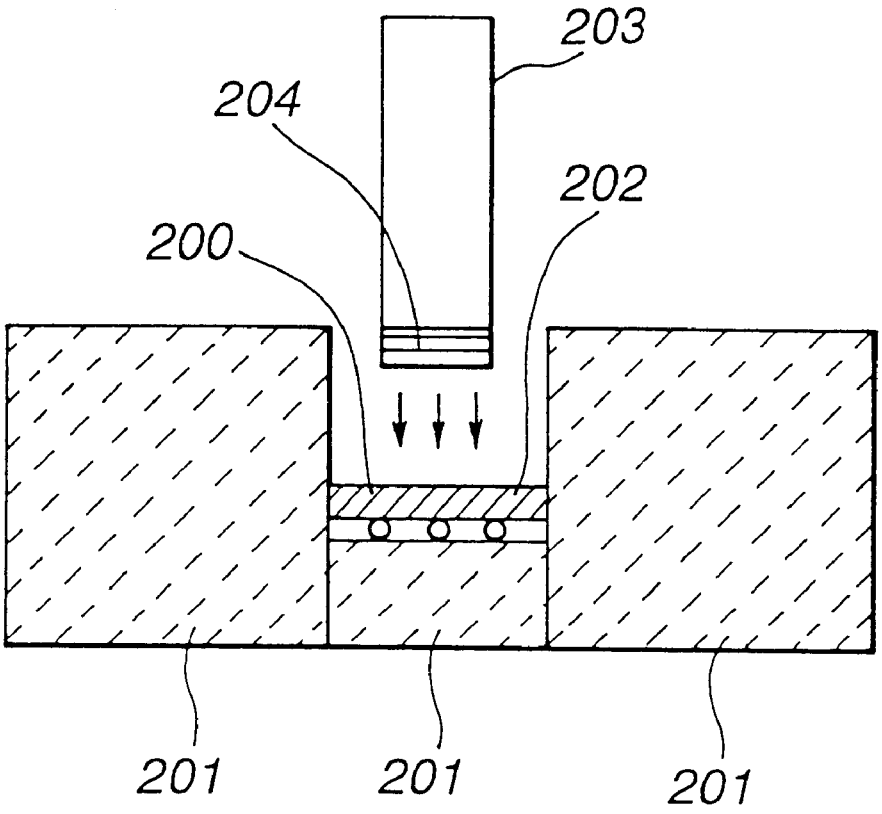
FIG. 10 is a schematic drawing showing a device for measuring an infrared-rays interception effect of plain weaves including the fiber structure.

Coolness provided by the plain weave is measured by a device as shown in FIG. 10. Referring to FIG. 10, the plain weave 200 is placed on a base of heat insulating material 201 made of polystyrene form, and it is enclosed by blocks of the same heat insulating material 201. The surface of the plain weave 200 is illuminated by a 100 W tungsten halogen lamp 203 arranged vertically thereabove. An infrared filter 204 is arranged on the output side of the tungsten halogen lamp 203 to provide only radiation in the infrared region to the plain weave 200. A variation in temperature of the back of the plain weave 200 with respect to time is measured by a high-precision thermocouple 202 arranged on the back of the plain weave 200. Measurement is carried out with regard to three samples of the plain weave 200.

For comparison, in a comparative example 1, using a fiber structure with the same sectional shape and area as that of the example 1 and with a single uniform PET layer, a plain weave is manufactured in the same conditions. A variation in temperature of the back of this plain weave with respect to time is measured by the measurement device. The ambient temperature is also measured for reference.

Figure 11:
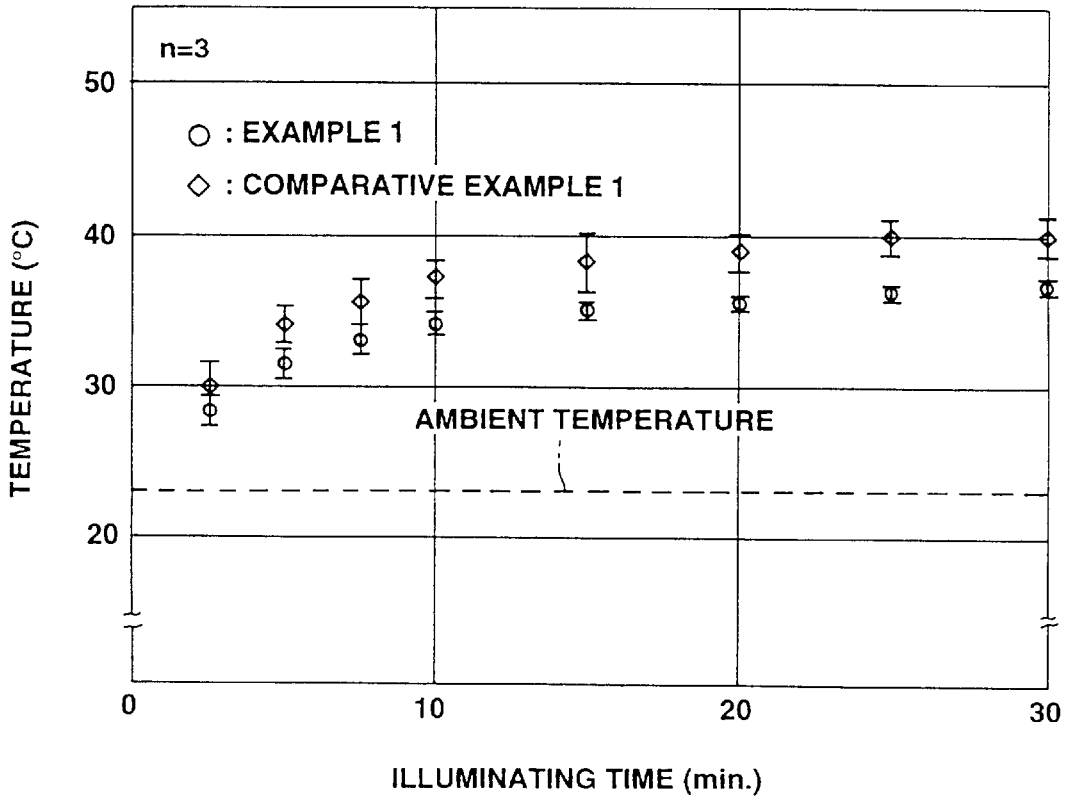
FIG. 11 is a view similar to FIG. 6, showing the results of measurement of an infrared-rays interception effect of the plain weaves relating to the first embodiment.

FIG. 11 shows the results of measurement, wherein circles designate the temperature of the plain weave 200 in the example 1, rhombuses designate the temperature of the plain weave in the comparative example 1, and a broken line designates the ambient temperature.

FIG. 11 reveals that the temperature of the back of the plain weave is lower in the example 1 than in the comparative example 1. After 30 min. illumination of the tungsten halogen lamp 203, the temperature difference between the two is about 3.0° C. Comparison of the results of measurement confirms that the fiber structure as described in the first embodiment produces an infrared-rays interception effect.

An example 2 corresponding to the first embodiment will be described, wherein the first material includes polyethylene naphthalate having 1.5 mole % of sodium sulfoisophthalate copolymerized (copolymerized PEN), and the second material includes nylon-6 (Ny-6). The use of copolymerized PEN in place of ordinary PEN aims to increase compatibility with Ny-6 or prevent breakaway. The refractive index na of the first material of copolymerized PEN is 1.63, and the refractive index nb of the second material of Ny-6 is 1.53. The thickness da of the first material or one copolymerized PEN layer is 0.153 $\mu$m, and the thickness db of the second material or one Ny-6 layer is 0.163 $\mu$m. Thus, $\lambda 1$ given by the formula (1) in the first embodiment is determined to about 1.0 $\mu$m.

Using the spinneret as disclosed in JP 9-133039, composite spinning is carried out at a spinning temperature of 274° C. and a take-up speed of 1,200 m/min. to obtain a unstretched thread with the flattening ratio B/A of 4.0. Then, heat stretching is carried out at a temperature of 140° C. and a speed of 300 m/min. to obtain the fiber structure having a protective layer arranged therearound and with a rectangular section as shown in FIG. 3C and the number N of alternate laminations of 30 pitches. The protective layer includes Ny-6, having a thickness of 2.5 $\mu$m.

Using filaments of the fiber structure as warp and weft, a plain weave is manufactured with warp density of 120/in. and weft density of 90/in.

Coolness is measured in the same way as in the example 1, which reveals that after 30 min. illumination of the tungsten halogen lamp, the temperature difference between the plain weave in the example 2 and that in the comparative example is about 3.0° C., which is equal to a value obtained in the example 1.

An example 2A corresponding to the first embodiment will be described, wherein the first material includes copolymerized PET, and the second material includes Ny-6. The use of copolymerized PET aims to increase compatibility with Ny-6 or prevent breakaway.

Copolymerized PET is prepared as follows. 1.0 mole of dimethyl terephthalate, 2.5 mole of ethylene glycol, and a varied amount of sodium sulfoisophthalate, and 0.0008 mole of calcium acetate and 0.0002 mole of manganese acetate which serve as an ester interchange catalyzer are charged into a reactor tank for agitation. Note that the amount of sodium sulfoisophthalate is varied in accordance with examples A–D and comparative examples A–C as shown in FIG. 13. A mixture in the reactor tank is gradually heated between 150 and 230° C. in accordance with the known method to carry out ester interchange. After eliminating a predetermined amount of methanol, 0.0012 mole of antimony trioxide serving as polymerization catalyzer is charged in the reactor tank, which undergoes gradual temperature increase and pressure decrease. Then, in removing ethylene glycol produced, the reactor tank is put in the state of a temperature of 285° C. and a degree of vacuum of 1 Torr or less. Under those conditions maintained, an increase in viscosity of the mixture is waited. When torque required to an agitator reaches a predetermined value, a reaction is terminated to extrude the mixture in water, obtaining pellets of copolymerized PET. The limiting viscosity of copolymerized PET is between 0.47 and 0.64. Regarding Ny-6, the limiting viscosity is 1.3.

Using the two polymers, i.e. copolymerized PET and Ny-6, composite spinning is carried out at a take-up speed of 1,000 m/min. to obtain the fiber structure with a rectangular section as shown in FIG. 3C and the number N of alternate laminations of 30 pitches. Filaments of the fiber structure are stretched by three times by a roller stretching machine to obtain stretched threads of 100 denier/11 filaments.

A section of the stretched thread is photographed by an electron microscope to measure the thicknesses of the first material or a copolymerized PET layer and the second material or a Ny-6 layer in the center of the section and a point thereof ⅛ the longitudinal length or length B in the X-axis direction (see FIG. 1A) distant from a longitudinal end. An average thickness of the copolymerized PET layer and the Ny-6 layer is given in FIG. 13.

Referring to FIG. 13, the examples A–D and the comparative examples A–D are evaluated with respect to a reflection spectrum peak, etc. As seen from FIG. 13, the example C gives the most excellent result of presence of a distinct peak at wavelength of 1.00 $\mu$m. Note that with the amount of a compatible agent too large, the melt viscosity of the polymers is decreased to have a bad influence on formability of lamination, resulting in lowered reflection and interference of radiation.

Using as warp and weft stretched threads of the example C, a plain weave is manufactured with warp density of 120/in. and weft density of 90/in.

Coolness is measured in the same way as in the example 1, which reveals that after 30 min. illumination of the tungsten halogen lamp, the temperature difference between the plain weave in the example 2A and that in the comparative example is about 3.0° C., which is equal to a value obtained in the example 1.

An example 2B corresponding to the first embodiment will be described, wherein the first material includes PET, and the second material includes Ny-6. Sodium alkylbenzene sulfonate is added to PET to increase compatibility with Ny-6 or prevent breakaway, obtaining pellets of PET. PET includes a dicarboxylic-acid component including phthalic or isophthalic acid and partly having a coordinate function given by a cationic agent. The cationic agent includes metallic salt of sulfonic acid. The dicarboxylic-acid component partly includes metallic salt of sulfoisophthalic acid.

Using the two polymers, i.e. PET containing sodium alkylbenzene sulfonate and Ny-6, composite spinning is carried out at a take-up speed of 1,000 m/min. to obtain the fiber structure with a rectangular section as shown in FIG. 3C and the number N of alternate laminations of 30 pitches. Filaments of the fiber structure are stretched by three times by a roller stretching machine to obtain stretched threads of 100 denier/11 filaments.

For comparison, in a comparative example, using PET containing no sodium alkylbenzene sulfonate and Ny-6, composite spinning is carried out in the similar way.

Regarding the example 2B, a photograph of a section of a stretched thread taken by an electron microscope shows no breakaway between a PET layer and a Ny-6 layer, having excellent alternate lamination. The thicknesses of the PET layer and the Ny-6 layer are 0.163 $\mu$m and 0.159 $\mu$m, respectively, which correspond to the primary peak wavelength $\lambda 1$ in the reflection spectrum. On the other hand, regarding the comparative example, a photograph of a section of a stretched thread shows some breakaway between a PET layer and a Ny-6 layer.

Using as warp and weft stretched threads of the fiber structure, a plain weave is manufactured with warp density of 120/in. and weft density of 90/in.

Coolness is measured in the same way as in the example 1, which reveals that after 30 min. illumination of the tungsten halogen lamp, the temperature difference between the plain weave in the example 2B and that in the comparative example is about 3.0° C., which is equal to a value obtained in the example 1.

An example 3 corresponding to the second embodiment will be described, wherein the first material includes PMMA, and the second material includes PET. The refractive index na of the first material of PMMA is 1.49, and the refractive index nb of the second material of PET is 1.60. The thickness da of the first material or one PMMA layer is 0.268 $\mu$m, and the thickness db of the second material or one PET layer is 0.250 $\mu$m. Thus, $\lambda 1$ given by the formula (1) in the first embodiment is determined to about 1.6 $\mu$m.

Using the spinneret as disclosed in U.S. patent application Ser. No. 08/602,057, composite spinning is carried out at a spinning temperature of 285° C. to obtain the fiber structure with a rectangular section as shown in FIG. 1B and the number N of alternate laminations of 15 pitches. The flattening ratio or ratio B/A of the length B of the fiber structure in the X-axis direction to the length A thereof in the Y-axis direction is 4.5.

Using filaments of the fiber structure as warp and weft, a plain weave is manufactured with warp density of 120/in. and weft density of 90/in.

A variation in temperature of the back of the plain weave with respect to time when illuminated by the tungsten halogen lamp is measured by the measurement device as shown in FIG. 10. Measurement is carried out with regard to three samples of the plain weave. For comparison, in a comparative example 3, using a fiber structure with a single uniform PET layer as in the example 1, a plain weave is manufactured in the same conditions.

Figure 12:
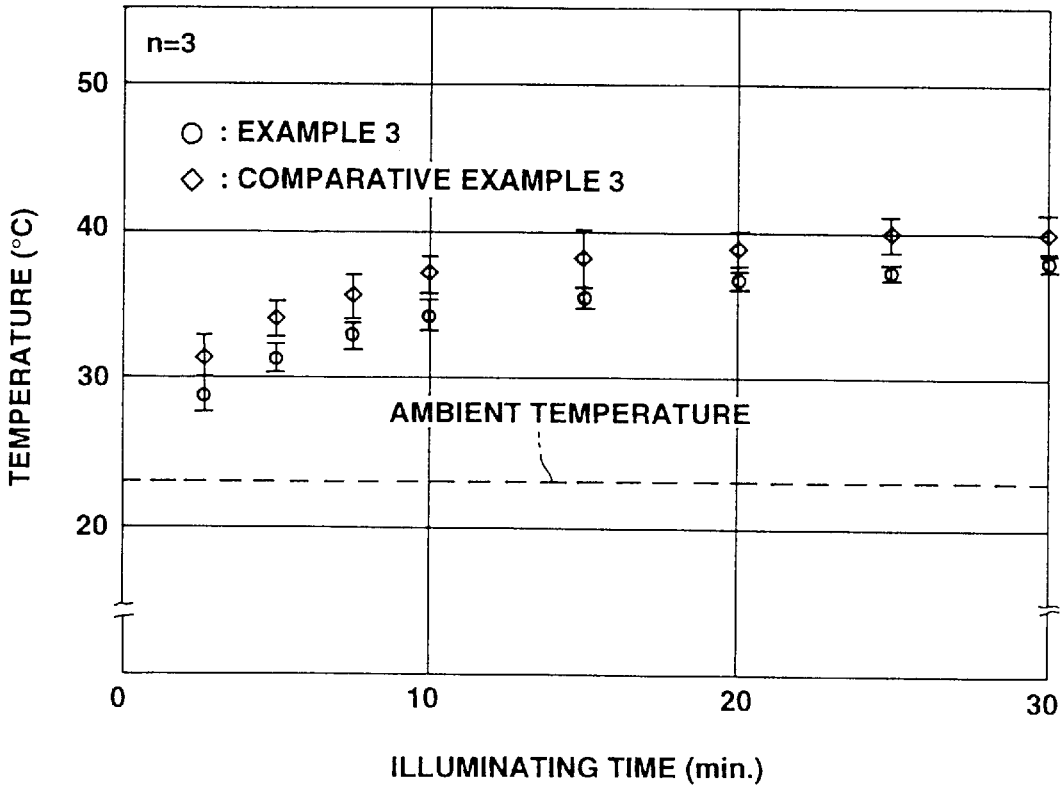
FIG. 12 is a view similar to FIG. 11, showing the results of measurement of an infrared-rays interception effect of the plain weaves relating to the third embodiment.

FIG. 12 shows the results of measurement, wherein circles designate the temperature of the plain weave in the example 3, rhombuses designate the temperature of the plain weave in the comparative example 3, and a broken line designates the ambient temperature.

FIG. 12 reveals that the temperature of the back of the plain weave is lower in the example 3 than in the comparative example 3. After 30 min. illumination of the tungsten halogen lamp, the temperature difference between the two is about 1.8° C. Comparison of the results of measurement confirms that the fiber structure as described in the second embodiment produces an infrared-rays interception effect.

An example 4 corresponding to the third embodiment will be described, which relates the combined structure including two second fiber structures 2 for reflecting visible rays, and a first fiber structure 1 interposed therebetween for reflecting infrared rays as shown in FIG. 7D.

The first fiber structure 1 for reflecting infrared rays includes the first material 101 of copolymerized PEN and the second material 102 of Ny-6. The refractive index na of the first material 101 of copolymerized PEN is 1.63, and the refractive index nb of the second material 102 of Ny-6 is 1.53. The thickness da of the first material 101 or one copolymerized PEN layer is 0.153 $\mu$m, and the thickness db of the second material 102 or one Ny-6 layer is 0.163 $\mu$m. Thus, $\lambda 1$ given by the formula (1) in the first embodiment is determined to about 1.0 $\mu$m. The number N of alternate laminations of the first fiber structure 1 is 10 pitches.

The second fiber structure 2 for reflecting visible rays also includes copolymerized PEN and Ny-6 as the first and second materials 105, 102. The thickness dc of the first material 101 or one copolymerized PEN layer is 0.072 $\mu$m, and the thickness de of the second material 102 or one Ny-6 layer is 0.077 $\mu$m. Thus, $\lambda 2$ given by the formula (4) in the third embodiment is determined to about 0.47 $\mu$m to produce blue. The number N of alternate laminations of each second fiber structure 2 is 10 pitches.

Using the spinneret as disclosed in JP 9-133039, composite spinning is carried out at a spinning temperature of 271° C. and a take-up speed of 1,200 m/min. to obtain a stretched thread with the flattening ratio B/A of 3.6. Then, heat stretching is carried out at a temperature of 140° C. and a speed of 300 m/min. to obtain the fiber structure having a protective layer arranged therearound and with a rectangular section as shown in FIG. 7D and the number N of alternate laminations of 30 pitches. The protective layer includes copolymerized PEN, having a thickness of 2.5 $\mu$m.

Using filaments of the fiber structure as warp and weft, a plain weave is manufactured with warp density of 120/in. and weft density of 90/in. coolness is measured in the same way as in the example 1, which reveals that after 30 min. illumination of the tungsten halogen lamp, the temperature difference between the plain weave in the example 4 and that in the comparative example is about 3.0° C., which is equal to a value obtained in the example 1. A color of the plain weave is varied from violet to blue-green in accordance with the angle.

The example 4 reveals that the combined fiber structure as shown in FIG. 7D not only provides coolness, but produces remarkable color.

An example 5 corresponding to the fourth embodiment will be described, wherein the combined fiber structure has a rectangular section, and includes a first fiber structure 1 and a second fiber structure 2 arranged therearound in a nest-like way. Each portion of the first and second fiber structures 1, 2 is arranged parallel to the outer periphery of the combined fiber structure.

The first fiber structure 1 for reflecting infrared rays includes the first material 101 of copolymerized PEN and the second material 102 of Ny-6. The refractive index na of the first material 101 of copolymerized PEN is 1.63, and the refractive index nb of the second material 102 of Ny-6 is 1.53. The thickness da of the first material 101 or one copolymerized PEN layer is 0.153 μm, and the thickness db of the second material 102 or one Ny-6 layer is 0.163 μm. Thus, λ1 given by the formula (1) in the first embodiment is determined to about 1.0 μm. The number N of alternate laminations of the first fiber structure 1 is 10 pitches.

The second fiber structure 2 for reflecting visible rays also includes copolymerized PEN and Ny-6 as the first and second materials 105, 102. The thickness dc of the first material 101 or one copolymerized PEN layer is 0.072 μm, and the thickness de of the second material 102 or one Ny-6 layer is 0.077 μm. Thus, λ2 given by the formula (4) in the third embodiment is determined to about 0.47 μm to produce blue. The number N of alternate laminations of the second fiber structure 2 is 20 pitches.

Using the spinneret as disclosed in JP 9-133039, composite spinning is carried out at a spinning temperature of 271° C. and a take-up speed of 1,200 m/min. to obtain a stretched thread with the flattening ratio B/A of 3.6. Then, heat stretching is carried out at a temperature of 140° C. and a speed of 300 m/min. to obtain the fiber structure having a protective layer arranged therearound and with a rectangular section as shown in FIG. 9B and the number N of alternate laminations of 30 pitches. The protective layer includes copolymerized PEN, having a thickness of 2.0 μm.

Using filaments of the fiber structure as warp and weft, a plain weave is manufactured with warp density of 120/in. and weft density of 90/in.

Coolness is measured in the same way as in the example 1, which reveals that after 30 min. illumination of the tungsten halogen lamp, the temperature difference between the plain weave in the example 4 and that in the comparative example is about 3.0° C., which is equal to a value obtained in the example 1. The plain weave produces a color of very bright blue-green generally, and between violet and blue-green with respect to any angle.

The example 5 reveals that combined fiber structure including fiber structures as shown in FIG. 9B not only provides coolness, but produces a remarkable coloring performance regardless of the angle.

The entire contents of Japanese Patent Applications P9-111625 filed Apr. 28, 1997, and P9-285622 filed Oct. 17, 1997 are incorporated herein by reference.

What is claimed is:

1. A fiber structure with a cross section having x-axis and y-axis directions, comprising:

an alternate lamination including:

a first portion having a refractive index na and a thickness da; and a second portion adjacent to said first portion, said second portion having a refractive index nb and a thickness db, wherein when $1.0 \leqq na < 1.8$, $1.3 \leqq nb \leqq 1.8$, and $1.03 \leqq nb/na \leqq 1.05$, a primary peak wavelength λ1 which is equal to 2(nada+nbdb) is given by $\lambda 1 \geqq 0.78$ (μm), which is included in a region of wavelength of infrared rays.

2. A fiber structure as claimed in claim 1, wherein said first and second portions are arranged in the y-axis direction of the cross section.

3. A fiber structure as claimed in claim 1, wherein said first and second portions are arranged concentrically.

4. A fiber structure as claimed in claim 1, wherein $0.78 \leqq \lambda 1 \leqq 2.00$ (μm), which is included in said region of wavelength of infrared rays contained in sunlight.

5. A fiber structure as claimed in claim 1, wherein said first and second portions are arranged in the y-axis direction of the cross section.

6. A fiber structure as claimed in claim 1, wherein said first and second portions are arranged concentrically.

7. A fiber structure as claimed in claim 1, wherein $1.6 \leqq \lambda 1 \leqq 20.0$ (μm), which is included in said region of wavelength of infrared rays of said artificial heat source.

8. A fiber structure as claimed in claim 1, further comprising:

another alternate lamination including a first portion and a second portion adjacent to said first portion, said another alternate lamination producing a predetermined effect.

9. A fiber structure as claimed in claim 8, wherein said predetermined effect is to produce a color by reflection and interference of light.

10. A fiber structure as claimed in claim 8, wherein said predetermined effect is to reflect ultraviolet rays.

11. A fiber structure as claimed in claim 8, wherein said first and second portions of said alternate lamination and said another alternate lamination are parallel to an outer periphery of the fiber structure.

12. A fiber structure as claimed in claim 11, wherein said first and second portions include thermoplastic resins.

13. A fiber structure as claimed in claim 12, wherein said thermoplastic resins include polymers including polyester, polyamide, vinyl, polyether ketone, polysulfide, fluoropolymer and polycarbonate, mixtures of two or more of said polymers, and copolymers thereof.

14. A fiber structure as claimed in claim 12, wherein said first portion includes fluoropolymer, and said second portion is selected from the group consisting of polyvinylidene chloride (PVDC), polyvinylidene fluoride (PVDF), polyester and polyphenyl sulfide (PPS).

15. A fiber structure as claimed in claim 12, wherein said first portion includes polymethyl methacrylate (PMMA), and said second portion includes polyethylene terephthalate (PET).

16. A fiber structure as claimed in claim 12, wherein said first portion includes polyethylene naphthalate having sodium sulfoisophthalate copolymerized (copolymerized PEN), and said second includes nylon-6 (Ny-6).

17. A fiber structure as claimed in claim 12, wherein said first portion includes polyethylene terephthalate (PET), and said second portion includes polyamide.

18. A fiber structure as claimed in claim 17, wherein said PET includes a dicarboxylic-acid component selected from the group consisting of phthalic and isophthalic acids, said dicarboxylic-acid component partly having a coordinate function given by a cationic agent.

19. A fiber structure as claimed in claim 18, wherein said cationic agent includes metallic salt of sulfonic acid.

20. A fiber structure as claimed in claim 18, wherein said dicarboxylic-acid component partly includes metallic salt of sulfoisophthalic acid.

21. A fiber structure as claimed in claim 12, wherein at least one of said first and second portions has a higher compatibility.

22. A fiber structure as claimed in claim 21, wherein said higher compatibility is ensured by addition of a compatible agent to said one of said first and second portions.

23. A fiber structure as claimed in claim 22, wherein said compatible agent is selected from the group consisting of metallic salt of alkylbenzene sulfonic acid and polyester amide.

24. A fiber structure as claimed in claim 21, wherein said higher compatibility is ensured by copolymerization of said first and second portions.

25. A fiber structure as claimed in claim 12, wherein at least one of said first and second portions includes ceramic particulates for reflecting infrared rays with wavelength equal to and greater than 0.78 $\mu$m.

26. A fiber structure as claimed in claim 25, wherein the content of said ceramic particulates is between 0.1 and 30.0% by weight.

27. A fiber structure as claimed in claim 25, wherein the content of said ceramic particulates is between 1.0 and 10.0% by weight.

28. A fiber structure as claimed in claim 11, wherein said first portion includes air, and said second portion includes a thermoplastic resin.

29. A cloth, comprising:

a fiber structure with a cross section having x-axis and y-axis directions, said fiber structure comprising:

an alternate lamination including:

a first portion having a refractive index na and a thickness da; and a second portion adjacent to said first portion, said second portion having a refractive index nb and a thickness db, wherein when $1.0 \leqq na < 1.8$, $1.3 \leqq nb \leqq 1.8$, and $1.01 \leqq nb/na \leqq 1.80$, a primary peak wavelength $\lambda 1$ which is equal to 2(nada+nbdb) is given by $\lambda 1 \geqq 0.78$ ($\mu$m), which is included in a region of wavelength of infrared rays.

30. A textile product, comprising:

a cloth including a fiber structure as claimed in claim 1.

31. A fiber structure as claimed in claim 1, wherein the fiber structure has an average reflectivity of infrared rays of about 30% or more.

* * * * *